US005708087A

United States Patent [19]

Buck et al.

[11] Patent Number: 5,708,087

[45] Date of Patent: Jan. 13, 1998

[54] CARBOXYLIC ACID-CONTAINING POLYMER/RESOLE STAIN-RESISTS

[75] Inventors: Robert Craig Buck, West Grove; Engelbert Pechhold, Chadds Ford, both of Pa.

[73] Assignee: E. I. Du Pont de Nemours and Company, Wilmington, Del.

[21] Appl. No.: 856,214

[22] Filed: May 14, 1997

Related U.S. Application Data

[63] Continuation of Ser. No. 606,134, Feb. 23, 1996, abandoned.

[51] Int. Cl.[6] ..... C08L 61/04; C08L 61/14; C08L 33/02

[52] U.S. Cl. ..... 525/136; 525/132; 525/480; 525/451; 525/508

[58] Field of Search ..... 525/451, 132, 525/136, 480, 508

[56] References Cited

U.S. PATENT DOCUMENTS

| | | | |
|---|---|---|---|
| 1,972,754 | 9/1934 | Biedermann | 260/3 |
| 4,146,686 | 3/1979 | Jones | 429/250 |
| 4,937,123 | 6/1990 | Chang et al. | 428/96 |
| 4,940,757 | 7/1990 | Moss, III et al. | 525/502 |
| 5,001,004 | 3/1991 | Fitzgerald et al. | 428/263 |
| 5,328,766 | 7/1994 | Smith | 428/378 |
| 5,346,726 | 9/1994 | Pechhold | 427/393.4 |
| 5,401,554 | 3/1995 | Armen | 428/96 |
| 5,436,049 | 7/1995 | Hu | 428/85 |
| 5,447,755 | 9/1995 | Pechhold et al. | 427/393.4 |
| 5,460,891 | 10/1995 | Buck et al. | 428/477.4 |

FOREIGN PATENT DOCUMENTS

| | | |
|---|---|---|
| 0 329 899 A | 8/1989 | European Pat. Off. . |
| 0 659 927 A | 6/1995 | European Pat. Off. . |
| 42 23 830 A | 1/1994 | Germany . |
| WO 91/14818 | 10/1991 | WIPO . |
| WO 91/19849 | 12/1991 | WIPO . |
| WO 92/10605 | 6/1992 | WIPO . |
| WO 92/12286 | 7/1992 | WIPO . |

*Primary Examiner*—W. Robinson H. Clark

[57] ABSTRACT

A composition which provides polyamide substrates with resistance to staining by acid dyes comprising (A) carboxylic acid-containing stain-resist polymers selected from:

(i) methacrylic acid polymers, or (ii) hydrolyzed copolymers of maleic anhydride with ethylenically unsaturated aromatics, alpha-olefins, alkyl vinyl ethers or alkyl allyl ethers or (iii) mixtures of (i) and (ii), and (B) resole condensates prepared by reacting bis(hydroxyphenyl)sulfone which contains no sulfonate or carboxylate groups with formaldehyde in the presence of an alkali metal hydroxide, at a bis(hydroxyphenyl)sulfone resole resin:carboxylic acid-containing stain-resist polymer weight ratio in the range between about 1:20 and 2.5:1.0 is disclosed.

12 Claims, No Drawings

CARBOXYLIC ACID-CONTAINING POLYMER/RESOLE STAIN-RESISTS

This is a continuation, of application Ser. No. 08/606,134 filed Feb. 23, 1996, now abandoned.

FIELD OF THE INVENTION

The present invention relates to compositions which provide polyamide substrates with resistance to staining by acid dyes. It relates also to polyamide textile substrates treated with such compositions, and processes for preparing such substrates.

BACKGROUND OF THE INVENTION

Polyamide substrates, such as nylon carpeting, upholstery fabric and the like, are subject to staining by a variety of agents, e.g., foods and beverages. An especially troublesome stain is FD&C Red Dye No. 40, commonly found in soft drink preparations. A composition which acts to render polyamide fiber substrates resistant to staining by such acid-dye colorants is referred to herein as a stain-resist composition. Different types of treatments have been proposed to deal with such staining problems. One proposed approach is to use stain-resist compositions containing sulfonated phenol-formaldehyde condensates, alone or in combination with methacrylic acid polymers, or styrene maleic acid copolymers or combinations of these. Hydrolyzed copolymers of maleic anhydride with ethylenically unsaturated aromatics, alpha-olefins, alkyl vinyl ethers or alkyl allyl ethers have also been used by themselves or in combination with sulfonated phenol-formaldehyde condensates to provide stain-resist compositions having improved resistance to yellowing from exposure to ultra-violet light (UV) or nitrogen oxides (NOx). Polymers of methacrylic acid have also been used by themselves or in combination with sulfonated phenol-formaldehyde condensates on polyamide substrates so as to impart resistance to staining by acid dyes which resists yellowing caused by exposure to UV or NOx. In another method, stain-resist compositions have been made by polymerizing methacrylic acid in the presence of a sulfonated phenol-formaldehyde condensate. A more recent approach is to use a stain-resist composition comprising phenol-formaldehyde condensates, such as bis (hydroxyphenyl)sulfone resole resins formed by base-catalyzed condensation of bis(hydroxyphenyl)sulfone with formaldehyde (see U.S. application Ser. No. 286,190 filed 5 Aug. 1994).

BRIEF SUMMARY OF THE INVENTION

The present invention relates to compositions comprising mixtures of bis(hydroxyphenyl)sulfone resole resins and carboxylic acid-containing hydrocarbon polymers (derived from carboxylic acid- or carboxylic anhydride-containing hydrocarbon monomers) which provide polyamide substrates with resistance to staining by acid dyes. It relates also to polyamide substrates treated with such compositions so as to impart stain-resistance to the substrates, and methods for imparting stain-resistance to polyamide textile substrates by use of the compositions of this invention. In particular the present invention comprises a composition which provides polyamide substrates with resistance to staining by acid dyes comprising (A) carboxylic acid-containing stain-resist polymers selected from:

(i) methacrylic acid polymers, or (ii) hydrolyzed copolymers of maleic anhydride with ethylenically unsaturated aromatics, alpha-olefins, alkyl vinyl ethers or alkyl allyl ethers, or (iii) mixtures of (i) and (ii), and (B) resole condensates prepared by reacting bis (hydroxyphenyl)sulfone which contains no sulfonate or carboxylate groups with formaldehyde in the presence of an alkali metal hydroxide, at a bis(hydroxyphenyl)sulfone resole resin:carboxylic acid-containing stain-resist polymer weight ratio in the range between about 1:20 and 2.5:1.0.

DETAILED DESCRIPTION OF THE INVENTION

The compositions of this invention comprise mixtures which provide a desirable balance of stain-resistance and anti-yellowing properties not achievable with the individual components themselves. The stain-resist compositions of the present invention provide improved stain-resistance after alkaline washing, compared with carboxylic acid-containing stain-resist polymers alone, and reduced yellowing of the treated substrate on exposure to UV or $NO_x$ in comparison to substrates treated with the bis(hydroxyphenyl)sulfone resole resin alone. The compositions of the present invention are effective over a wide range of proportions of bis (hydroxyphenyl)sulfone resole resin and carboxylic acid-containing stain-resist polymer. A useful ratio is a bis (hydroxyphenyl)sulfone resole resin:carboxylic acid-containing stain-resist polymer weight ratio in the range between about 1:20 and 2.5:1. Preferably, the ratio is in the range between about 1:10 and 1:1, and most preferably between 1:4 and 1:9.

The resoles used in this invention are made, in accordance with the aforesaid U.S. application, by condensation of bis(hydroxyphenyl)sulfone with formaldehyde in basic aqueous medium comprising an alkali metal or alkaline earth metal hydroxide, under an inert atmosphere at elevated temperature and under autogenous pressure. The molar ratio of formaldehyde to bis(hydroxyphenyl)sulfone is in the range between 0.6 to 1 and 1.1 to 1, preferably between 0.75 to 1 and 0.9 to 1. The molar ratio of alkali or alkaline earth metal metal hydroxide to bis(hydroxy-phenyl)sulfone is in the range between 0.1 to 1 and 3.5 to 1, preferably between 0.2 to 1 and 1 to 1. If the formaldehyde to bis (hydroxyphenyl)sulfone molar ratio is too high, gellation will occur; if the molar ratio is too low, a significant quantity of unreacted bis(hydroxyphenyl)sulfone will remain in the product. Too high or too low a molar ratio of alkali metal or alkaline earth hydroxide to bis(hydroxyphenyl)sulfone yields a resole product which is incapable of imparting satisfactory acid dye stain-resistance to polyamide substrates. Reaction conditions may vary; i.e. in order to complete the condensation reaction, temperatures should be in the range between 100° to 200° C., preferably 125° to 150° C., and the reaction should be run over a time period of 0.25 to 24 hours, preferably 0.25 to 6 hours. At the end of the condensation, the product is cooled to room temperature, and, if necessary, dissolved in sufficient 10 weight % aqueous alkali or alkaline earth metal hydroxide to give a clear brownish solution. Bases suitable for dissolving the resole resins of this invention are the same as those listed above for use in the condensation reaction.

In a preferred embodiment, the present invention provides novel compositions comprising the above-described resole resins combined with a wide variety of carboxylic acid-containing stain-resist polymers such as:

(i) hydrolyzed copolymers of maleic anhydride with ethylenically unsaturated aromatics, alpha-olefins, alkyl vinyl ethers or alkyl allyl ethers, or (ii) methacrylic acid polymers, or combinations of (i) and (ii) to provide compositions with improved yellowing compared with the resole resins alone and improved stain-resistance after alkaline washing compared with the carboxylic acid-containing stain-resist polymers alone.

A variety of ethylenically unsaturated aromatic compounds can be used for the purpose of preparing the hydrolyzed polymers of this invention. Those aromatic compounds can be represented by the formula:

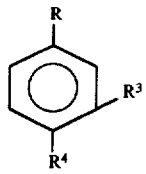

wherein R is $R^1-CH=\overset{R^2}{\overset{|}{C}}-$ or $CH_2=CH-CH_2-$;

$R^1$ is H—, $CH_3$— or 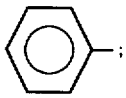 ;

$R^2$ is H— or $CH_3$—;

$R^3$ is H— or $CH_3O$—;

$R^4$ is H—, $CH_3$—, or $CH_3CO$—, and $R^3$ plus $R^4$ is $-O-CH_2-O-$.

Specific examples of ethylenically unsaturated aromatic compounds suitable for the purposes of this invention include styrene, alpha-methylstyrene, 4-methyl styrene, stilbene, 4-acetoxystilbene (used to prepare a hydrolyzed polymer from maleic anhydride and 4-hydroxy-stilbene), eugenol acetate, isoeugenol acetate, 4-allylphenol acetate, safrole, mixtures of the same, and the like. From the stand-point of cost-effectiveness, a copolymer prepared from styrene and maleic anhydride at a 1:1 molar ratio is preferred. The hydrolyzed polymers can have molecular weights (number average) in the range between about 500 and 4000, preferably between about 800 and 2000. They are readily soluble, even at high concentrations, in water at neutral to alkaline pH; increasing dilution is needed at a pH below 6. Such copolymers and their preparation are disclosed in U.S. Pat. No. 5,001,004, issued Sep. 13, 1994.

Similarly, a number of allyl ethers and vinyl ethers can be used for the purposes of this invention. Particularly useful ethers include those which can be represented by the formula:

$$CH_2=CH-(CH_2)_k-O-(CH_2)_m-(A)_n-R$$

wherein

R is hydrogen or an alkyl radical containing 4 to 8 carbon atoms, or 2,3-epoxypropyl, or an alicyclic hydrocarbon radical containing 6 to 12 carbon atoms, or an aromatic hydrocarbon radical containing 6 to 12 carbon atoms, or a perfluoroalkyl radical containing 3 to 16 carbon atoms, preferably 6 to 12, and which may contain a terminal $-CF_2H$ group; A is a divalent radical $-SO_2R^1-$ or $-CONR^1-$ in which $R^1$ is hydrogen or an alkyl radical containing 1 to 6 carbon atoms;

k is 0 or 1;

m is 0 or 2; and n is 0 or 1.

Particular examples include n-butyl vinyl ether, isobutyl vinyl ether, iso-octyl vinyl ether, 2-perfluorohexylethyl vinyl ether, allyl n-butyl ether, allyl phenyl ether, allyl glycidyl ether, and the like. The foregoing polymers and their preparation are described in U.S. Pat. No. 5,346,726 issued Sep. 13, 1994.

Likewise, various linear and branched chain alpha-olefins can be used for the purposes of this invention. Particularly useful alpha-olefins include dienes containing 4 to 18 carbon atoms, such as butadiene, chloroprene, isoprene, and 2-methyl-1,5-hexadiene; preferably 1-alkenes containing 4 to 12 carbon atoms, such as isobutylene, 1-butene, 1-hexene, 1-octene, 1-decene, and 1-dodecene, with 1-octene being most preferred. A part of the alpha-olefins can be replaced by other monomers, e.g. up to 50 wt % of alkyl($C_{1-4}$) acrylates, alkyl($C_{1-4}$) methacrylates, vinyl acetate, vinyl chloride, vinylidine chloride, vinyl sulfides, N-vinyl pyrrolidone, acrylonitrile, acrylamide, as well as mixtures of the same. A part (1–75%) of the maleic anhydride can be replaced by maleimide, N-alkyl($C_{1-4}$) maleimides, N-phenyl-maleimide, fumaric acid, itaconic acid, citraconic acid, acontic acid, crotonic acid, cinnamic acid, alkYl($C_{1-18}$) esters of the foregoing acids, cycloalkyl($C_{3-8}$) esters of the foregoing acids, sulfated castor oil, or the like. At least 95 wt % of the maleic anhydride co- or terpolymers have a number average molecular weight of in the range between about 700 and 200,000, preferably between about 1000 and 100,000. The foregoing polymers and their preparation are described in U.S. application Ser. No. 07/809,843 filed 18 Dec. 1992.

In one embodiment, methacrylic acid polymers suitable for the purposes of the present invention consist essentially of more than 75 weight percent of methacrylic acid and 0 to less than 25 weight percent of one or more ethylenically unsaturated monomers other than methacrylic acid. Such ethylenically unsaturated monomers include, for example, monocarboxylic acids, polycarboxylic acids, and anhydrides; substituted and unsubstituted esters and amides of carboxylic acids and anhydrides; nitriles; vinyl monomers; vinylidene monomers; monoolefinic and polyolefinic monomers; and heterocyclic monomers. Representative specific comonomers include, for example, acrylic acid, itaconic acid, citraconic acid, aconitic acid, maleic acid, maleic anhydride, fumaric acid, crotonic acid, cinnamic acid, oleic acid, palmitic acid, vinyl sulfonic acid, vinyl phosphonic acid, alkyl or cycloalkyl esters of the foregoing acids, the alkyl or cycloalkyl groups having 1 to 18 carbon atoms such as, for example, ethyl, butyl, 2-ethylhexyl, octadecyl, 2-sulfoethyl, acetoxyethyl, cyanoethyl, hydroxyethyl and hydroxypropyl acrylates and methacrylates, and amides of the foregoing acids, such as, for example acrylamide, methacrylamide, methylolacrylamide, and 1,1-dimethylsulfoethyl-acrylamide, acrylonitrile, methacrylonitrile, styrene, alpha-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, vinylidene chloride, sulfated castor oil, sulfated sperm oil, sulfated soybean oil, and sulfonated dehydrated castor oil. Particularly useful monomers include, for example, alkyl acrylates having 1–4 carbon atoms, itaconic acid, sodium sulfostyrene, and sulfated castor oil. Mixtures of the monomers, such as, for example, sodium sulfostyrene and styrene, and sulfated castor oil and acrylic acid, can be copolymerized with the methacrylic acid. The foregoing polymers and their preparation are disclosed in U.S. Pat. No. 4,937,123.

In another embodiment, the methacrylic acid polymers suitable for the purposes of the present invention relate to those prepared by polymerizing methacrylic acid, with or without at least one other ethylenically unsaturated monomers described above, in the presence of sulfonated hydroxy-aromatic compound/formaldehyde condensation resins. Those homopolymers and copolymers and their preparation are described in U.S. Pat. No. 4,940,757. Typically, methacrylic acid, or a methacrylic acid copolymer (described above), is mixed with a sulfonated aromatic resin solution in a ratio ranging from 30:1 to 1:1 of methacrylic acid to sulfonated phenol-formaldehyde condensation resin solids, with a preferred ratio of approximately 8:1. For example, 16 grams of glacial methacrylic acid can be mixed with 6 grams of a 30% solids solution of sulfonated condensation resin (1.8 grams of solid). A free radical chain initiator such as potassium persulfate, ammonium persulfate, or sodium persulfate is added to initiate polymerization. The reaction is heated to approximately 50°–100° C. with stirring for a time ranging from about 30 minutes to 2 hours on a laboratory bench scale, or a time sufficient to react all but less than about 1% monomer. Preferred reaction conditions are at 90° C. for 1 hour. The resulting cooled polymeric solution has an acidic pH, and typically 12–15 grams of solids per 100 grams of solution. If there are more than 15 percent solids in the solution, the solution approaches the form of a gel. As the ratio of the methacrylic acid to resin decreases, the viscosity of the resulting solution decreases. Viscosity can be adjusted with hydrotropes such as sodium xylene sulfonate, sodium cumene sulfonate, sodium toluene sulfonate or sodium dodecyl diphenyl oxide disulfonate.

Polyamide fiber or fabric can be rendered resistant to staining by acid dyes when contacted with aqueous solutions or dispersions of the composition of this invention at various pH values followed by a steaming or heating. The compositions of this invention can be exhausted from a bath onto polyamide fiber or fabric at relatively low concentrations ranging from 0.1 to 5.0% of the weight of fiber (owf), preferably at 0.3–2.0% owf. Optionally, surfactants and/or electrolytes can be added to the aqueous solutions in order to provide improved solubility and/or exhaust.

The compositions of this invention can be applied in the presence of added electrolyte which can range from 0.01 up to 10% preferably 1 to 5%, based on the weight of the application bath. The electrolyte is based on any mono- or polyvalent cation or anion. Monovalent cations which can be used in this invention include ammonium, lithium, sodium or potassium, etc. Polyvalent cations which can be used in this invention include any water-soluble salt based on barium, calcium, magnesium, strontium, aluminum, zinc, etc. Any water-soluble mono- or polyvalent anion could be used in this invention such as fluoride, chloride, bromide, iodide, hypochloride, chlorate, bromate, iodate, carbonate, bicarbonate, sulfate, sulfite, bisulfite, thiosulfate,nitrate, nitrite, phosphate, hypophosphite, monohydrogen phosphate, dihydrogen phosphate, pyrophosphate, tripolyphosphate, polyphosphate, borate, silicate, metasilicate, cyanate, thiocyanate, formate, acetate, propionate, oxalate, tartrate, citrate, glycolate, thioglycolate, tetraborate, dithionite, etc.

To provide the solubility of the compositions of this invention at pH below about 6.0, the use of surfactants is sometimes preferred. The amount of surfactant is that necessary to provide a stable aqueous dispersion of the compositions of this invention. Thus, the requirement for and amount of surfactant can be determined by one skilled, in the art by observing the aqueous system containing the compositions of this invention. For example, one can use an alkylated di-sulfonated diphenyl oxide (such as that sold be Dow Chemical Co. under the trademark "DOWFAX", by Pilot Chemical Co. under the trademark "CALFAX", and by American Cyanamid Co. under the trademark "AEROSOL DPOS"), or alpha-olefin sulfonates (such as that sold by Pilot Chemical Co. under the trademark "CALSOFT"), or sodium dodecylbenzene sulfonate, or sodium lauryl sulfate (such as that sold by Witco Chemical Co. under the trademark "DUPONOL WAQE"). The amount of surfactant can range from a minimum of 2.5 up to 500% based upon the weight of bis-(hydroxyphenyl)sulfone resole resin and carboxylic acid-containing stain-resist polymer, preferably in the range between about 5% and 25%.

Exhaust or fixation of the compositions of this invention can be accomplished at bath or solution temperatures ranging from 20°–110° C. over a few seconds to one hour. The compositions of this invention can be effectively applied by a wide variety of methods known to those skilled in the art, such as: knife over roll overflow applicator (i.e., Kusters Roll), padding, spraying (i.e., Otting Spray Applicator), foaming in conjunction with foaming agents (i.e., Kusters Foam Applicator, Kusters "FLUICON", Gaston County FFT), batch exhaust in beck dyeing equipment, or continuous exhaust during a continuous dyeing operation (i.e. Kusters "FLEX-NIP", or Kusters "FLUIDYER").

The compositions of this invention can be applied by such methods to dyed or undyed polyamide textile substrates. In addition, the compositions of this invention can be applied to polyamide fiber via a finish during fiber spinning, fiber processing such as twisting, heat setting, or combinations of any of these operations. The compositions of this invention can be applied to such substrates in the absence or presence of a fluorinated oil-, water-, and/or soil-repellent materials. In the alternative, such a fluorinated material can be applied to the textile substrate before or after application of the polymers of this invention thereto. In addition, oil-, water-, and soil-repellent fluorochemical compositions can be applied in combination with the compositions of this invention. The fluoro-chemical composition is added to the treatment solution in the desired amount.

In addition, the compositions of this invention can be applied in-place to a polyamide substrate, such as carpeting or fabric, which has already been installed in a dwelling place, office or other locale. The compositions can be applied as a simple aqueous preparation by spray or in the form of an aqueous shampoo preparation such as a foam, either alone or in combination with oil-, water-, and soil-repellent fluorochemical compositions. The compositions can be applied at the levels described previously herein in a pH range between about 1 and 12, preferably between about 2 and 9.

The following examples are given in further illustration of the invention but not by way of limitation. Unless otherwise indicated, all parts and percentages are by weight and temperatures in the Examples are in degrees Celsius. Tables 1 and 2 summarize the example compositions and application levels, respectively.

TEST METHODS

The following test methods were used to evaluate carpet and fiber samples. Results are shown following the example compositions in Table 1.

1. FIBER STAIN TEST

Nylon fiber (DuPont "ANTRON" nylon 1150 bulked-continuous filament two-ply, Superba heatset) was treated with the desired % owf of stain-resist at a goods-to-liquor ratio of 1:20 at the desired pH value and temperature, in the presence or absence of electrolytes and/or a commercial alkylated di-sulfonated diphenyl oxide surfactant ("DOWFAX 2A4", Dow Chemical Co.) added to the treatment bath. The fiber was then washed with water, air-dried and exposed at room temperature to a dye solution consisting of 0.2 g of FD&C Red Dye No. 40 and 3.2 g of citric acid in one liter of de-ionized water at a goods-to-liquor ratio of 1:40. After approximately 24 hours, the fiber was removed, rinsed with water then air dried. The fiber specimens were visually inspected and the amount of color remaining in the specimen rated according to the following scale:

5=no staining
4=slight staining
3=noticeable staining
2=considerable staining
1=heavy staining Thus, a stain rating of 5 is excellent, showing outstanding stain-resistance, whereas 1 is the poorest rating, comparable to an untreated control sample.

2. CARPET STAIN TEST

A carpet specimen (3×5 inch) is placed on a flat non-absorbent surface. Twenty ml of a red dye solution consisting of 0.2 g FD&C Red 40 and 3.2 g citric acid in 1 liter of de-ionized water is poured into a 2-inch diameter cylinder which is placed tightly over the specimen.

The cylinder is removed after all the red dye solution has been absorbed. The stained carpet specimen is left undisturbed for 24 hours, after which it is rinsed thoroughly under cold tap water and squeezed dry. The specimens are visually inspected and the amount of color remaining in the stained area rated according to the following stain rating scale:

5=no staining
4=slight staining
3=noticeable staining
2=considerable staining
1=heavy staining As stated above, a stain rating of 5 is excellent, showing outstanding stain-resistance, whereas 1 is the poorest rating, comparable to an untreated control sample.

3. SHAMPOO-WASH DURABILITY TEST

A fiber or carpet specimen is submerged for 5 minutes at room temperature in a detergent solution consisting of sodium lauryl sulfate (dodecyl sodium sulfate) such as "DUPONOL WAQE" (1.5 g per liter) and adjusted with dilute sodium carbonate to a pH of 10. The specimen is then removed, rinsed thoroughly under tap water, de-watered by squeezing, and air-dried. The specimen is then tested according to the corresponding fiber or carpet stain test described above.

4. UV LIGHTFASTNESS

The colorfastness to UV light was measured according to AATCC Test Method 16E-1987. The specimens were rated after exposure to 40 AATCC Fading Units (AFU) according to the Gray Scale (ISO International Standard 105/I Part 2) for color change.

5. NOX COLORFASTNESS

The colorfastness to oxides of nitrogen was carried out according to AATCC Test Method 164-1987. At the end of 2 cycles the specimens were rated according to the Gray Scale (ISO International standard R105/I Part 2) for color change.

6. FLEX-NIP APPLICATION TO CARPET

To 40 oz/sq.yd. carpet from DuPont "ANTRON" nylon bulked continuous filament (BCF), Superba heatset, nylon fiber was applied an aqueous treatment solution comprised of the bis(hydroxyphenyl)sulfone resole resin and carboxylic acid-containing stain-resist polymer on a continuous dye range using a Kusters "FLEX-NIP" at approximately 350% wet-pick-up (wpu) followed by heating in a vertical cloud steamer for approximately two minutes. The carpet was then washed, vacuum extracted and dried for approximately fifteen minutes at 250° F. in a horizontal electric tenter frame or as appropriate. Application levels are shown in Table 2.

The aqueous treatment solutions were prepared by mixing aqueous solutions of the bis(hydroxyphenyl)sulfone resole resin and the carboxylic acid-containing stain-resist polymer or the bis(hydroxyphenyl)sulfone resole or carboxylic acid-containing stain-resist polymer alone to deliver approximately 1.0% owf. The pH of the treatment solution was then adjusted to the desired value, 2.2 for the mixtures of bis (hydroxyphenyl)sulfone resole resin and carboxylic acid-containing stain-resist or the carboxylic acid-containing stain-resist alone, and 7.0 for the bis(hydroxyphenyl)sulfone resole resin alone. In general, 0.05% to 5.0% owf of a commercially available alkylated disulfonated diphenyl oxide surfactant was added to the treatment bath containing the mixture of bis(hydroxyphenyl)sulfone resole resin and carboxylic acid-containing stain-resist or the carboxylic acid-containing stain-resist alone to improve solution stability.

7. EXHAUST APPLICATION

Nylon fiber was treated with between 0.6% and 1.2% owf stain-resist at a liquor to goods ratio of between 20:1 and 40:1 at 80° C. for between fifteen and thirty minutes.

The treatment solutions were prepared by mixing aqueous solutions of the bis(hydroxyphenyl)sulfone resole resin and the carboxylic acid-containing stain-resist polymer or the bis(hydroxyphenyl)sulfone resole resin or carboxylic acid-containing stain-resist polymer alone to deliver the desired % owf. The pH of the treatment solution was then adjusted to the desired value, 2.2 for the mixtures of bis (hydroxyphenyl)sulfone resole resin and carboxylic acid-containing stain-resist polymer or the carboxylic acid-containing stain-resist polymer alone, and 7.0 for the bis (hydroxyphenyl)sulfone resole resin alone. In general, 0.05% to 5.0% owf of a commercially available alkylated disulfonated diphenyl oxide surfactant was added to the treatment bath containing the mixture of the bis (hydroxyphenyl)sulfone resole resin and carboxylic acid-containing stain-resist polymer and the carboxylic acid-containing stain-resist polymer alone to provide solution stability. Application levels are shown in Table 2.

The BHPS used in this invention can be 4,4'-sulfonyldiphenol or its isomers, such as 2,4'-sulfonyldiphenol, 2,2'-sulfonyldiphenol, etc. or mixtures of the same. The base useful as the catalyst can be any inorganic compound having a pKa of 8.5 or greater which, when dissolved in water, renders it basic and which does not add to formaldehyde; for example, ammonia should not be used. Examples of such base include but are not limited to alkali metal hydroxides, alkali metal carbonates, alkali metal bicarbonates, alkali metal borates, alkaline earth metal hydroxides, alkaline earth metal carbonates, alkaline earth metal borates or mixtures thereof. The preferred base is sodium or potassium hydroxide, most preferably sodium hydroxide.

Generally one uses a basic aqueous medium, elevated temperature, autogenous pressure, and for safety, under an inert atmosphere. The molar ratio of formaldehyde to BHPS is in the range between 0.6:1.0 and 4.0:1.0, preferably in the range between 0.6:1.0 and 1.1:1.0, and most preferably in the range between 0.7:1.0 and 0.9:1.0. The molar ratio of base to BHPS is in the range between 0.1:1.0 and 3.5: 1.0, preferably in the range between 0.2:1.0 and 1.0:1.0. When the formaldehyde to BHPS molar ratio is in the range between 0.6:1.0 and 1.1:1.0, all of the base can be added at the start of the reaction at a preferred molar ratio of base to BHPS is in the range between 0.2:1.0 and 0.8:1.0. Reaction conditions may vary; i.e. in order to complete the condensation reaction, temperatures should be in the range between 100° and 200° C., and the reaction should be run over a time period of one-quarter hour to twenty four hours. At formaldehyde to BHPS molar ratios in the range between 1.1:1.0 and 4.0:1.0, it is preferred that the base be added in two stages so as to prevent gellation. It is also preferred that in the range between 0.2 and 0.8 mole of base per mole of BHPS be added at the start of the reaction and that the reaction be run at 80°–100° C., preferably 100° C., for 4–12 hours, most preferably at 100° C. for 6 hours. After completion of the 4–12 hour reaction time period, additional base is added (0.4 and 3.3 moles of base per mole of BHPS, preferably 1.0 mole of base per mole of BHPS). The reaction is then heated to a temperature in the range between 100° and 200° C., preferably in the range between 125° and 150° C., over a time period of one-quarter hour to 24 hours, preferably one-quarter to six hours. At the end of the condensation reaction, whether one or two stages, the product is cooled to room temperature, and, if necessary, dissolved in sufficient aqueous base to give a translucent brownish solution. Bases suitable for dissolving the resole resins of this invention are the same as those used in the condensation reaction.

The hydrolyzed styrene-maleic anhydride (SMA) copolymer was prepared according to the method disclosed in U.S. Pat. No. 5,001,004. Polymethacrylic acid polymers are widely available commercially. The polymethacrylic acid polymer used in Examples 5 and 6 was a 25% aqueous solution available as "DAXAD" 34 from Hampshire Chemical Co., Lexington, Mass. The hydrolyzed isobutylene-maleic anhydride (IBMA) copolymers are those disclosed in U.S. patent application Ser. No. 08/350,349 filed 6 Dec. 1994.

EXAMPLES

In the carpet and fiber evaluations that follow, stain-resistance and yellowing were measured by the techniques described above in the Test Methods section.

The compositions of examples 1–16 are shown in Table 1 below. The bis(hydroxyphenyl)sulfone resole resin of Examples 1 through 16 was prepared in accordance with Example 9 of U.S. patent application Ser. No. 08/286,190, filed 5 Aug. 1994. The hydrolyzed styrene-maleic acid polymer of Examples 1–4 was prepared in accordance with the process of Example 1 of U.S. Pat. No. 5,001,004. The polymethacrylic acid polymer of Examples 5 and 6 was "DAXAD" 34 brand. The copolymer of Examples 7–10 was commercially available "ISOBAM"-04 isobutylene-maleic anhydride copolymer MW~10,000 (IBMA-04), and that of Examples 11–14 was commercially available ISOBAM-01 isobutylene-maleic anhydride copolymer MW~40,000 (IBMA-01), both from Kuraray Co., Japan.

Examples 1–4 are compositions comprising bis (hydroxyphenyl)sulfone resole resin and hydrolyzed styrene-maleic anhydride (SMA) copolymer.

The bis(hydroxyphenyl)sulfone Resole resin was prepared in accordance with the method disclosed in U.S. application Ser. No. 07/286,190, filed 5 Aug. 1994, in which a bis(hydroxyphenyl)sulfone (BHPS) was reacted with formaldehyde in the presence of a base.

Examples 5 and 6 are compositions comprising bis (hydroxyphenyl)-sulfone resole resin and polymethacrylic acid (PMAA)

Examples 7–10 are compositions comprising bis (hydroxyphenyl)-sulfone resole resin and isobutylene-maleic arthydride copolymer (IBMA-04).

Examples 11–14 are compositions comprising bis (hydroxyphenyl)-sulfone resole resin and hydrolyzed isobutylene-maleic acid (IBMA-01).

Examples 15 and 16 are compositions comprising bis (hydroxyphenyl)-sulfone resole resin and methacrylic acid polymerized in the presence of the bis(hydroxyphenyl) sulfone resole resin.

In Example 15, a 1000 ml multi-neck flask, under nitrogen atmosphere and equipped with mechanical stirring, reflux condenser, and temperature controller, was charged with 39.3 ml (43.45 g, 0.5 mol) methacrylic acid and 250 g deionized water. The pH was adjusted to about 7.0 with 30% aqueous sodium hydroxide, then a solution of 4.8 g bis (hydroxyphenyl)sulfone resole resin in 19.2 g deionized water (the latter solution containing 20% active ingredient) and 0.71 g sodium persulfate were added to the reaction mixture and the mixture heated to 60° C. for 60 minutes. The solution remained transparent and homogeneous and was allowed to cool to ambient temperature.

Example 16 was prepared as in Example 15 except that 9.6 g of bis(hydroxyphenyl)sulfone resole resin in 38.4 g deionized water (the latter solution containing 20% active ingredient) were added with the 0.71 g sodium persulfate, and the reaction mixture heated as before. The solution again remained transparent and homogeneous and was allowed to cool to ambient temperature.

TABLE 1

COMPOSITION OF EXAMPLES 1–16

| Example | BHPS PMAA Resole | Hydrol. SMA | PMMA | IBMA-04 | Hydrol. IBMA-01 | Hydrol. Copolym. |
|---|---|---|---|---|---|---|
| 1 | 10 | 90 | — | — | — | — |
| 2 | 15 | 85 | — | — | — | — |
| 3 | 25 | 75 | — | — | — | — |
| 4 | 50 | 50 | — | — | — | — |
| 5 | 15 | — | 85 | — | — | — |
| 6 | 50 | — | 50 | — | — | — |
| 7 | 10 | — | — | 90 | — | — |
| 8 | 15 | — | — | 85 | — | — |
| 9 | 25 | — | — | 75 | — | — |
| 10 | 50 | — | — | 50 | — | — |
| 11 | 10 | — | | 90 | — | — |
| 12 | 15 | — | — | — | 85 | — |
| 13 | 25 | — | — | — | 75 | — |
| 14 | 50 | — | — | — | 50 | — |
| 15 | 10.9 | — | — | — | — | 89.1 |
| 16 | 19.6 | — | — | — | — | 80.4 |

TABLE 2

APPLICATION LEVELS FOR EXAMPLES 1–16

| | % Active Ingredient owf | |
|---|---|---|
| | Fiber | Carpet |
| EXAMPLE | | |
| 1 | 0.6 | 1.0 |
| 2 | 0.6 | 1.0 |
| 3 | 0.6 | 1.0 |
| 4 | 0.6 | 1.0 |
| 5 | 1.0 | — |
| 6 | 1.0 | — |
| 7 | 1.2 | — |

TABLE 2-continued

APPLICATION LEVELS FOR EXAMPLES 1–16

| | % Active Ingredient owf | |
|---|---|---|
| | Fiber | Carpet |
| 8 | 1.2 | — |
| 9 | 1.2 | — |
| 10 | 1.2 | — |
| 11 | 1.2 | — |
| 12 | 1.2 | — |
| 13 | 1.2 | — |
| 14 | 1.2 | — |
| 15 | 1.0 | — |
| 16 | 1.0 | — |
| CONTROL | | |
| BHPS Resole | 0.8 | 0.8 |
| SMA | 1.0 | 1.0 |
| PMAA | 1.0 | — |
| ISOBAM-01 ™ | 1.2 | — |
| ISOBAM-04 ™ | 1.2 | — |

Example 1 was tested in fiber tests and Examples 2–4 were tested in both carpet and fiber tests, and showed better resistance to UV and NOx yellowing than bis (hydroxyphenyl)sulfone resole resin alone, and improved shampoo durability compared with hydrolyzed SMA copolymer alone.

Examples 5, 6, 15, and 16 were tested in fiber tests and showed better resistance to NOx yellowing than bis (hydroxyphenyl)sulfone resole resin alone, and improved shampoo durability compared with polymethacrylic acid (PMAA) polymer alone. Examples 15 and 16 (in which the methacrylic acid was polymerized in the presence of the bis(hydroxyphenyl)sulfone resin) were slightly superior to Examples 5 and 6 (in which prepolymerized polymethacrylic acid was mixed with the bis(hydroxyphenyl) sulfone resin) in the shampoo test.

Examples 7–10 were tested in fiber tests and showed better resistance to UV and NOx yellowing than bis (hydroxyphenyl)sulfone resole resin alone, and improved shampoo durability compared with the hydrolyzed copolymer derived from commercially available "ISOBAM-04" isobutylene-maleic anhydride copolymer alone.

Examples 11–14 were tested in fiber tests and showed better resistance to UV and NOx yellowing than bis (hydroxyphenyl)sulfone resole resin alone, and improved shampoo durability compared with hydrolyzed copolymer derived from commercially available "ISOBAM-01" isobutylene-maleic anhydride copolymer alone.

We claim:

1. A composition which provides polyamide substrates with resistance to staining by acid dyes comprising (A) carboxylic acid-containing stain-resist polymers selected from:

(i) methacrylic acid polymers, or (ii) hydrolyzed copolymers of maleic anhydride with ethylenically unsaturated aromatics, alpha-olefins, alkyl vinyl ethers or alkyl allyl ethers, or (iii) mixtures of (i) and (ii), and (B) resole condensates which contain no sulfonate groups prepared by reacting bis(hydroxyphenyl)sulfone which contains no sulfonate or carboxylate groups with formaldehyde in the presence of an alkali metal hydroxide, at a bis(hydroxyphenyl)sulfone resole resin:carboxylic acid-containing stain-resist polymer weight ratio in the range between about 1:20 and 2.5:1.0.

2. The composition of claim 1 wherein said resole condensate is prepared at a formaldehyde:bis(hydroxyphenyl) sulfone molar ratio in the range between 0.6:1.0 and 1.1:1.0 and an alkali metal hydroxide:bis(hydroxyphenyl)sulfone molar ratio in the range between 0.1:1.0 and 3.5:1.0.

3. The composition of claim 1 wherein said carboxylic acid-containing polymer is a methacrylic acid polymer which is a copolymer of methacrylic acid.

4. The composition of claim 1 wherein said carboxylic acid-containing polymer is a methacrylic acid polymer which is polymethacrylic acid.

5. The composition of claim 1 wherein said carboxylic acid-containing polymer is a methacrylic acid polymer which is prepared in said presence of a resole condensate.

6. The composition of claim 1 wherein said carboxylic acid-containing polymer is a hydrolyzed copolymer of maleic anhydride with ethylenically unsaturated aromatics, alpha-olefins, alkyl vinyl ethers or alkyl allyl ethers which is a copolymer of maleic anhydride with ethylenically unsaturated aromatics or alpha-olefins.

7. The composition of claim 6 wherein said ethylenically unsaturated alpha-olefin is a 1-alkene containing 4 to 12 carbon atoms.

8. The composition of claim 6 wherein said ethylenically unsaturated alpha-olefin comprises 1-octene.

9. The composition of claim 6 wherein said ethylenically unsaturated aromatics are those represented by the formula:

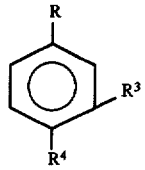

wherein R is $R^1-CH=C(R^2)-$ or $CH_2=CH-CH_2-$;

$R^1$ is H—, $CH_3$— or 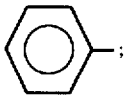 ;

$R^2$ is H— or $CH_3$—;

$R^3$ is H— or $CH_3O$—;

$R^4$ is H—, $CH_3$—, or $CH_3CO$—, and $R^3$ plus $R^4$ is $-O-CH_2-O-$.

10. The composition of claim 6 wherein said ethylenically unsaturated aromatic comprises styrene.

11. A polyamide substrate having resistance to staining by acid dyes comprising a polyamide substrate having applied thereto the composition of claim 1.

12. A method for imparting to a polyamide substrate stain-resistance to acid dye colorants comprising contacting a polyamide substrate with an aqueous solution comprising the composition of claim 1 and recovering a polyamide substrate having resistance to staining by acid dyes.

* * * * *